US008091333B2

(12) United States Patent
Lee

(10) Patent No.: US 8,091,333 B2
(45) Date of Patent: Jan. 10, 2012

(54) FLEXIBLE WIRE FOR REMOVING SCALE IN PIPE

(75) Inventor: Kwang Ho Lee, Yongin-si (KR)

(73) Assignee: E2ST Co., Ltd., Seoul (KR)

( * ) Notice: Subject to any disclaimer, the term of this patent is extended or adjusted under 35 U.S.C. 154(b) by 0 days.

(21) Appl. No.: 12/675,559

(22) PCT Filed: Sep. 2, 2008

(86) PCT No.: PCT/KR2008/005146

§ 371 (c)(1),
(2), (4) Date: Feb. 26, 2010

(87) PCT Pub. No.: WO2009/031795

PCT Pub. Date: Mar. 12, 2009

(65) Prior Publication Data

US 2010/0236002 A1 Sep. 23, 2010

(30) Foreign Application Priority Data

Sep. 3, 2007 (KR) ..... 10-2007-0088911

(51) Int. Cl.
*D02G 3/02* (2006.01)
*D02G 3/22* (2006.01)

(52) U.S. Cl. ..... 57/210

(58) Field of Classification Search ..... 57/211, 57/238; 15/104.06, 104.05, 104.066–104.068, 15/104.09, 104.16, 104.31, 104.33; 600/104, 600/121, 123, 128, 139, 140, 153
See application file for complete search history.

(56) References Cited

U.S. PATENT DOCUMENTS

| | | | | | |
|---|---|---|---|---|---|
| 34,862 | A * | 4/1862 | Morgan et al. | 57/222 |
| 1,955,024 | A * | 4/1934 | Rohs | 174/129 S |
| 2,022,839 | A * | 12/1935 | Austin | 174/127 |
| 2,620,618 | A * | 12/1952 | Chamoux | 57/215 |
| 2,961,675 | A * | 11/1960 | Stickney | 15/104.33 |
| 3,457,580 | A * | 7/1969 | Meyers | 15/104.33 |
| 5,105,612 | A * | 4/1992 | Brown | 57/213 |
| 2002/0000015 | A1 | 1/2002 | Rothenberger | |
| 2010/0000035 | A1 * | 1/2010 | Lee | 15/104.05 |

FOREIGN PATENT DOCUMENTS

| | | | |
|---|---|---|---|
| JP | 2000-175923 | A | 6/2000 |
| JP | 2002-096039 | A | 4/2002 |
| KR | 10-2006-0131326 | A | 12/2006 |
| KR | 10-0701830 | B | 3/2007 |
| WO | WO2007/123335 | A | 11/2007 |

* cited by examiner

*Primary Examiner* — Shaun R Hurley
(74) *Attorney, Agent, or Firm* — Sherr & Vaughn, PLLC

(57) ABSTRACT

Provided is a flexible wire to be inserted in a pipe and rotated in a high speed to remove scales in the pipe by striking the scales. The flexible wire includes a main wire line which is formed by alternately winding a central wire line with clockwise and counterclockwise wires along a longitudinal direction of the central wire line, an auxiliary wire line which is a single line having a diameter smaller than that of the main wire line and extends in a longitudinal direction of the main wire line, and an outermost wire which winds the auxiliary wire line so as to bind the auxiliary wire line and the main wire line.

2 Claims, 4 Drawing Sheets

[Fig. 6]
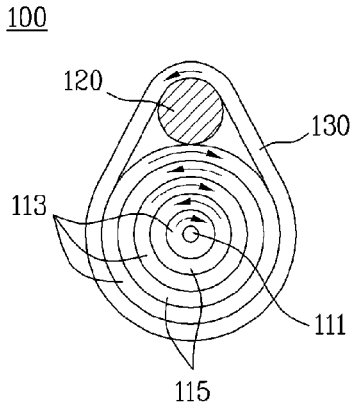
[Fig. 7]
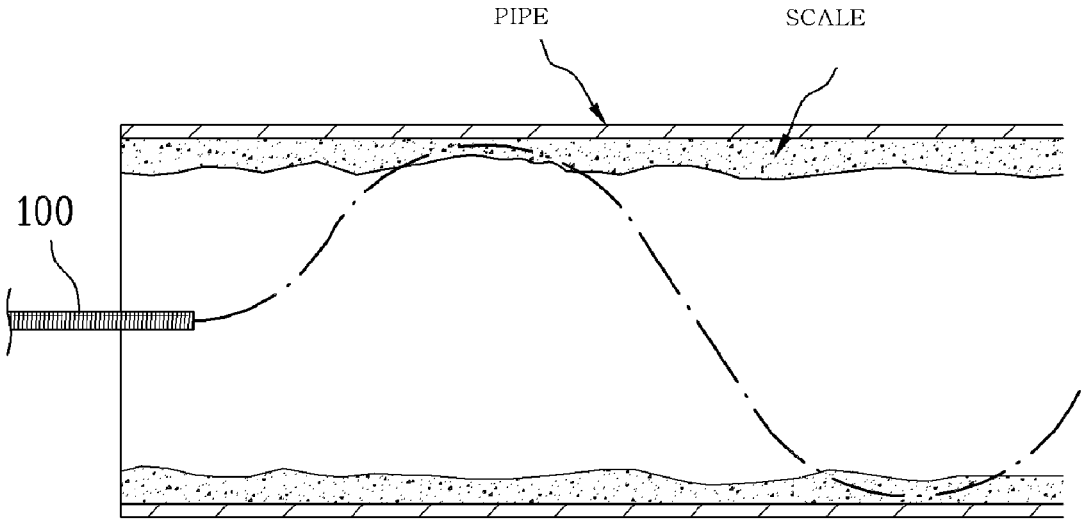

FLEXIBLE WIRE FOR REMOVING SCALE IN PIPE

CROSS REFERENCE TO PRIOR APPLICATIONS

This application is a National Stage Patent Application of International Patent Application No. PCT/KR2008/005146 (filed on Sep. 2, 2008) under 35 U.S.C. 371, which claims priority to Korean Patent Application No. 10-2007-0088911 (filed on Sep. 3, 2007), which are both hereby incorporated by reference in their entirety.

TECHNICAL FIELD

The present invention relates to an apparatus for removing scale in a pipe, and more particularly, to a flexible wire which is inserted in a pipe and rotated in a high speed during operation of an apparatus to remove scale produced in the pipe by striking.

BACKGROUND ART

In general, pipes are used as passages through which water or other liquids are guided and moved. Pipes are typically buried in floors or walls of buildings.

As such pipes are used for a relatively long time, inner surfaces of the pipes are eroded, and various contaminants are easily stuck on the inner surfaces, so that scales may be produced. The scale may be solidified as time passes, and thus, a diameter of the pipe passage is narrowed.

Once the pipe passage is narrowed due to the scale, fluidal material cannot be smoothly moved through the pipe, so that the pipe may not function as its design. Furthermore, due to motional pressure of the fluidal material, the pipe may be destructed. Therefore, if much scale is produced in the pipe, the scale needs to be immediately removed so as for the pipe to normally function.

As one of the widely-used methods of removing the scale in pipe, there is a method of removing scale, in which water mixed with chemicals passes the pipe, and the chemicals contact with the scale to cause a chemical reaction, so that the scale can be dissolved into water.

However, in the method of removing scale in pipe by using chemicals, there is a need for an additional unit such as an air sprayer. In addition, since the chemicals are used, relatively high caution is needed for a working process. In addition, the pipe may be damaged by the chemicals during the process of removing the scale. In addition, since the chemical is expensive, much cost is needed for the working process.

Furthermore, even though some chemicals used for removing scale do not harm to humans, water consumers have anxieties about the chemicals. Particularly, since people who live in ordinary houses have a negative attitude toward the method of removing scale by using the chemicals, the problems caused from the production of scale cannot be easily solved.

In order to solve the aforementioned problems, the inventor of the present invention contrived various techniques relating the removing of scale in pipe. The inventor has several patents (Korean Patent Nos. 324449, 533508, 533509, and 533510). The inventor's applications (Korean Patent Application Nos. 2006-0025347, 2006-0025348, and 2006-0025895) are pending.

In the patent-granted or pending inventions of the applicant of the present invention, a flexible wire is inserted into an inner portion of a pipe, and after that, the flexible wire is rotated at a high speed, so that the rotating flexible wire respectively has an impact on scale produced in the inner portion of the pipe so as for the scale to be removed. Since no chemicals are used in the inventions, the techniques of the inventions are agreeably accepted by the residents of an apartment building where water is supplied through the pipes.

Hereinafter, the latest one among the inventions which were contrived and filed previously by the same inventor will be described with reference to FIG. 1 of the accompanying drawings.

FIGS. 1 and 2 are front view illustrating an apparatus for removing scale in pipe which was filed previously by the same inventor of the present invention. The apparatus for removing scale in pipe includes: a supporting plate 1 which is supported on a ground; a moving plate 3 which is disposed on the supporting plate to move horizontally forward and backward along a guide rail 2; a motor 4 which is fixed on the moving plate and supplied with an electric power to generate positive and negative driving forces; a hollow shaft 5 which is inserted into a central portion of the motor to rotation by the driving forces of the motor 4; a wire housing 6 which is fixed at one end of the hollow shaft to rotate together with the hollow shaft at the time of rotation; a flexible wire 7 which is contained in the wire housing in a wound state and of which distal end is designed to penetrate the hollow shaft 5 of the motor 4 and to be extracted to a forward side, that is, toward a side opposite to the wire housing 6; a wire locking member 8 which is fixed to the forward side opposite to the wire housing on the upper surface of the moving plate 3 to support one end of the hollow shaft 5 and selectively lock the flexible wire 7 as needed; a wire protection pipe 9 which is fixed to an flexible-wire extracting portion of the wire locking member to protect a portion of the flexible wire that is not inserted into an inner portion of the pipe; and a pipe supporting plate 10 which is fixed on the supporting plate 1 to be separated from the wire locking member 8 so as to support the wire protection pipe 9 in a horizontal state.

Now, processes of removing scale produced on an inner portion of the pipe by using the apparatus for removing scale in pipe having the above structure will be described.

The distal end of the flexible wire 7 wound in the wire housing 6 is extracted through the hollow shaft 5 of the motor 4. The distal end of the extracted flexible wire 7 is passed through the wire locking member 8 and further extracted outward through the wire protection pipe 9 which is supported by the pipe supporting plate 10. Next, the extracted portion of the flexible wire 7 is inserted into the inner portion of the pipe, of which scale is to be removed.

The above-described state denotes a state that the moving plate 8 to which the motor 7 is fixed is moved forward, that is, toward the pipe. It can be understood that, in the state, the locking of the flexible wire 7 by using the wire locking member 8 needs to be released so as for the flexible wire 7 to rotate at a high speed by the driving of the motor in the later-described processes.

After the flexible wire 7 is inserted into the inner portion of the pipe, the motor 4 is driven at a high speed by a control signal of a controller (not shown). Since the driving force is transmitted to the wire housing 6 through the hollow shaft 5, the wire housing 6 together with the hollow shaft 5 can be rotated at a high speed. As a result, the flexible wire 7 can also be rotated at a high speed so as to have an impact on the inner diameter surface of the pipe, so that the scale produced on the inner portion of the pipe can be removed.

On the other hand, in a case where a worker further inserts the flexible wire 7 into the inner portion of the pipe down to a deeper site so as to increase a scale-removed region of the pipe, the motor 4 is moved backward in the state shown in FIG. 1, and after that, the motor is moved forward. This process is described in detail as follows.

The worker pushes the motor backward with the hand in a state the driving of the motor 4 is stopped. Therefore, the moving plate 3 to which the motor 4 is fixed is guided along the guide rail 4 on the supporting plate 4 so as to be smoothly moved backward as shown in FIG. 2. As a result, the wire housing 6 together with the motor 4 is moved backward. In this case, the flexible wire 7 wound in the wire housing 6 is unwound by a length thereof in proportion to a backward moving distance.

Subsequently, the worker locks the flexible wire 7 by using the wire locking member 8, and after that, the worker pushes the motor with the hand again. Therefore, the moving plate 3 to which the motor is fixed is guided along the guide rail 2 so as to be moved forward. In this case, since the wire locking member 8 locks the flexible wire 7, the flexible wire 7 is further moved forward and inserted into the inner portion of the pipe down to a deeper side in proportion to the forward moving distance of the motor 4. In this state, the locking of the flexible wire 7 by using the wire locking member 8 is released, and the motor is driven again. As a result, due to the rotation of the wire housing 6, the flexible wire 7 is rotated at a high speed, and the scale produced at a deeper site of the inner portion of the pipe can be removed.

DISCLOSURE OF IVENTION

Technical Problem

As shown in FIGS. 3 and 4, a conventional flexible wire 7 has an integral structure formed by spirally twisting several strands in a bound state. Although not shown, the conventional flexible wire has a structure formed with only the straight main wire line 70 having a circular cross section. Since the conventional flexible wire 7 is formed with only the single straight main wire line 70 having a circular cross section, there is a limitation to a diameter of rotation due to a centrifugal at a high speed rotation in a state that the flexible wire is inserted into an inner portion of a pipe in a using process. Therefore, the conventional flexible wire has several problems in effectively removing scale in a large-diameter pipe.

In order to solve the above problem, a technique for increasing the diameter of the main wire line 70 of the flexible wire may be considered so as to improve the centrifugal force. This technique may slight improve the effect. However, as the diameter of the main wire line 70 is increased, the bending ability of the flexible wire is decreased in proportion to the increase of the diameter of the main wire line. As a result, the conventional flexible wire has a limitation to remove scale in a large-diameter pipe.

The present invention is contrived in order to solve the aforementioned problems of the conventional flexible wire. The present invention is to a flexible wire capable of effectively removing scale in a large-diameter pipe by increasing a diameter of rotation due to a centrifugal force at a high speed rotation.

Technical Solution

According to an aspect of the present invention, there is provided a flexible wire for removing scale in pipe, comprising: a main wire line which is formed by alternately winding a central wire line with clockwise and counterclockwise wires along a longitudinal direction of the central wire line; an auxiliary wire line which is a single line having a diameter smaller than that of the main wire line and extends in a longitudinal direction of the main wire line; and an outermost wire which winds the auxiliary wire line so as to bind the auxiliary wire line and the main wire line.

BRIEF DESCRIPTION OF THE DRAWINGS

FIG. 6 is a cross-sectional view of FIG. 5.

FIG. 7 is a front view illustrating a usage state of the flexible wire for an apparatus for removing scale in pipe according to the present invention.

BEST MODE FOR CARRYING OUT THE INVENTION

Figure 1:
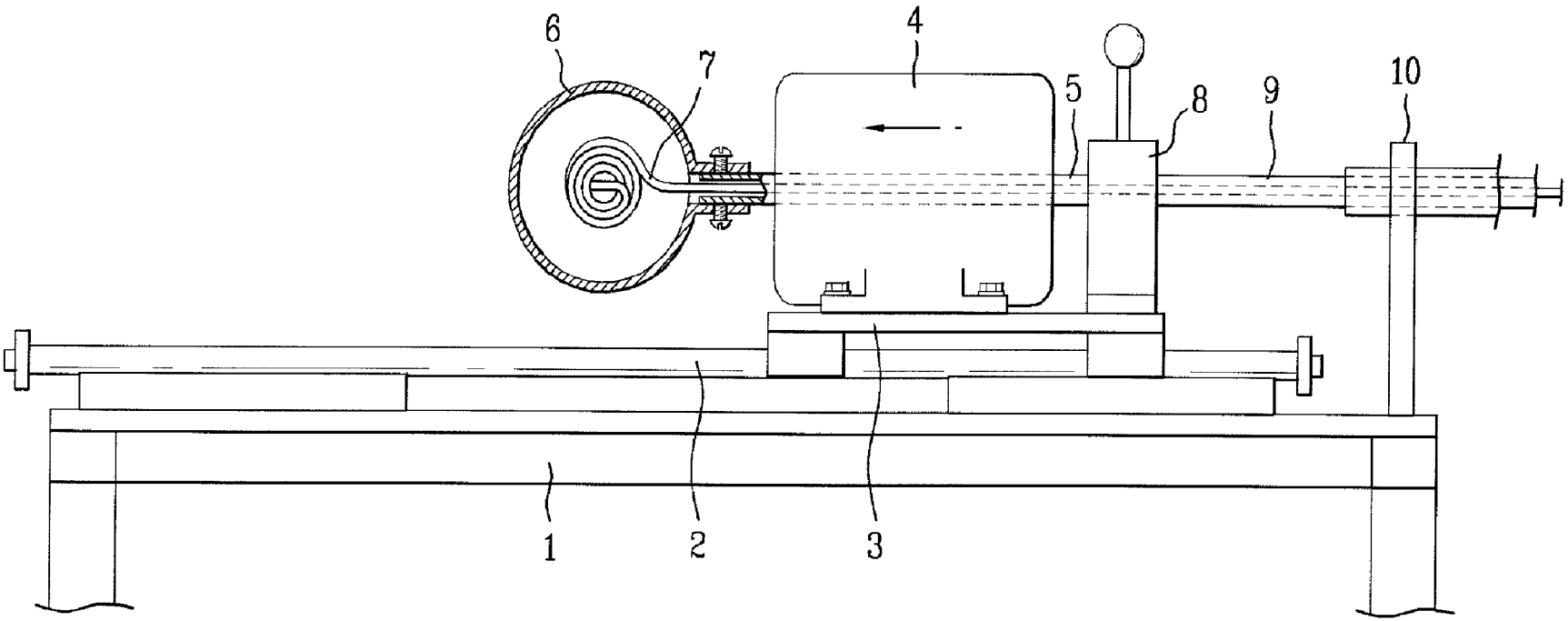
FIG. 1 Related Art
FIG. 1 is a front view illustrating an apparatus for removing scale in pipe which was filed previously by the same inventor of the present invention, which illustrates a state that a motor and a wire housing are moved forward by a moving plate.
Figure 2:
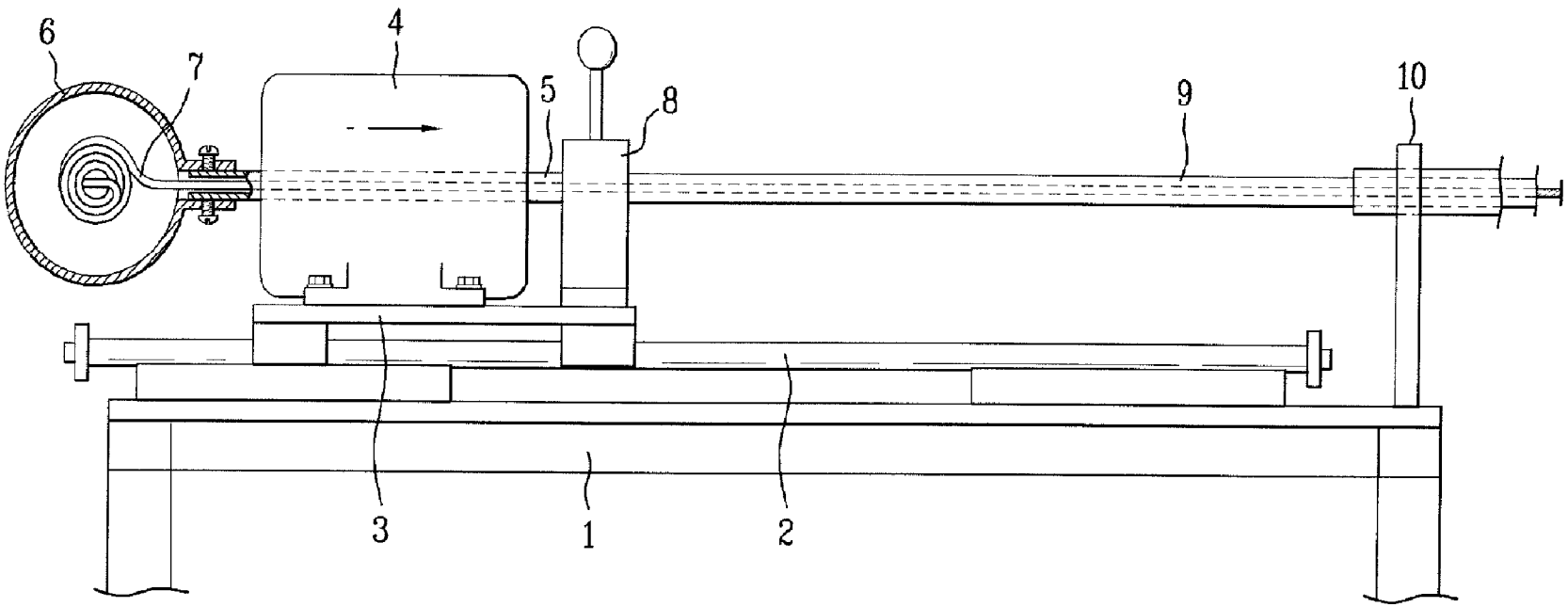
FIG. 2 Related Art
FIG. 2 is a front view illustrating the apparatus for removing scale in pipe which was filed previously by the same inventor of the present invention, which illustrates a state that the motor and the wire housing are moved backward by the moving plate.
Figure 3:
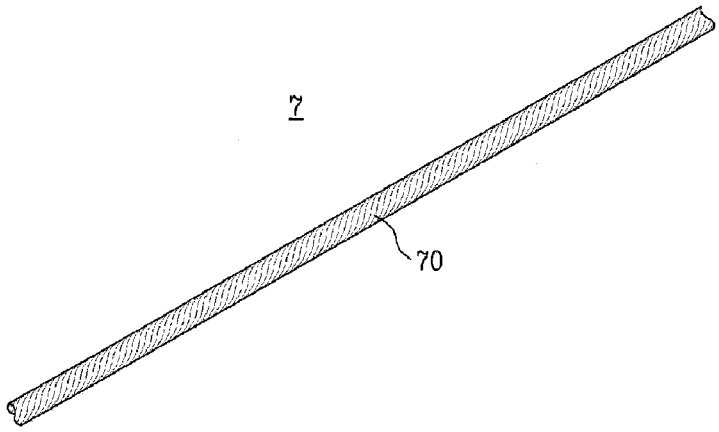
FIG. 3 Related Art
FIG. 3 is a perspective view illustrating a flexible wire for a conventional apparatus for removing scale in pipe.
Figure 4:
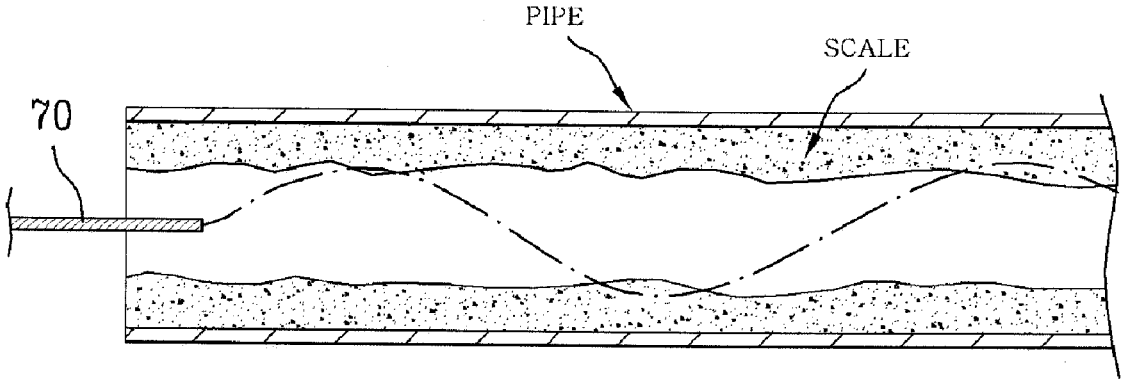
FIG. 4 is a front view illustrating a usage state of the flexible wire for the conventional apparatus for removing scale in pipe.
Figure 5:
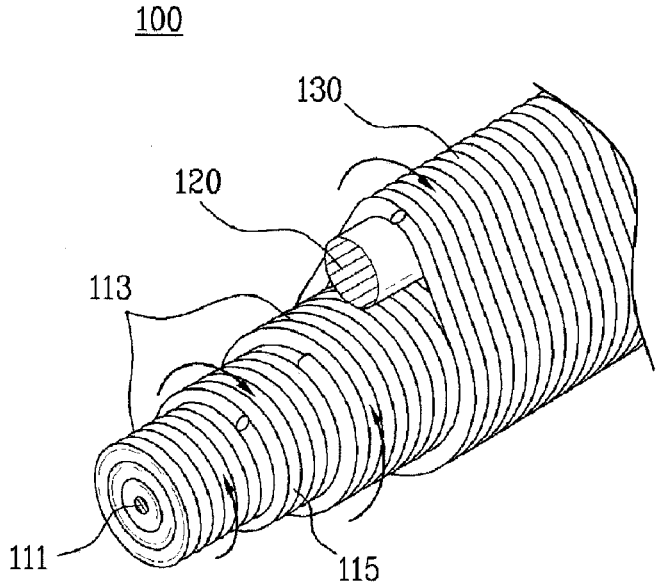
FIG. 5 is a perspective view illustrating a flexible wire for an apparatus for removing scale in pipe according to the present invention, in which wire surface is removed step by step in order to illustrate an internal structure.

As shown in FIGS. 5 and 6, a flexible wire 100 for removing scale in pipe according to the present invention includes: a main wire line 110 which is formed by alternately winding a central wire line with clockwise and counterclockwise wires along a longitudinal direction of the central wire line; an auxiliary wire line 120 which is a single line having a diameter smaller than that of the main wire line 110 and extends in a longitudinal direction of the main wire line; and an outermost wire 130 which winds the auxiliary wire line so as to bind the auxiliary wire line 120 and the main wire line 110.

The main wire line 110 is formed by winding the central wire line with the clockwise wire along the longitudinal direction of the central wire line in a positive direction, winding the central wire line with the counterclockwise wire in a negative direction, and respectively performing the winding multiple times.

When the main wire line 110 is rotated in the positive direction, the negatively wound wire may be unwound. However, the wire which positively winding around the unwound wire is further wound, so that the unwinding is prevented. In addition, when the main wire line 110 is rotated in the negative direction, the positively wound wire may be unwound. However, the wire which negatively winding around the unwound wire is further wound, so that the unwinding is prevented. As a result, the main wire line can be rotated and used in any direction without the unwinding.

The auxiliary wire line 120 is formed as a single line having a diameter smaller than that of the main wire line 110 and is disposed at one side of the main wire line 110 to extend in the longitudinal direction of the main wire line 110. In addition, the auxiliary wire line 120 and the main wire line 110 are wound by the outermost wire 130 so as to be bound with each other.

The outermost wire 130 needs to be made of a material having a strength enough to firmly bind the main wire line 110 and the auxiliary wire line even in a high speed rotation. The outermost wire 130 is wound in a direction opposite to the winding direction of the main wire line 110 so as for the outermost wire not to be unwound.

Therefore, due to the auxiliary wire line 120, the flexible wire 110 is formed to have a cross section having an eccentricity.

On the other than, the diameter of the auxiliary wire line 120 is designed to be smaller than that of the main wire line 110. Since the diameter of the main wire line 110 is larger than that of the auxiliary wire line 120, the main wire line 110 can maintain balance even in a centrifugal force at the high speed rotation, so that the flexible wire 100 can be rotated at a high speed by the centrifugal force in a stable state.

In addition, the auxiliary wire line 120 needs to be have elasticity. Therefore, the auxiliary wire line can elastically correspond to the diameter of rotation of the main wire line 110.

As shown in FIG. 7, the flexible wire 100 according to the present invention can be suitably used for removing scale in a larger-diameter pipe than a smaller-diameter pipe. This is because the flexible wire 100 having eccentricity has a larger diameter of rotation due to the centrifugal force at the time of rotation than a general flexible wire having a circular cross section. Therefore, the flexible wire 100 according to the present invention can be used for removing scale in a large-diameter pipe.

In addition, the flexible wire 100 according to the present invention has a stronger impact on an inner diameter portion of the pipe so as to remove scale produced on the inner surface of the pipe than the general flexible wire having a circular cross section. Therefore, it can be understood that a scale removing ability of the flexible wire 100 according to the present invention can be greatly improved.

INDUSTRIAL APPLICABILITY

According to a flexible wire for an apparatus for removing scale in pipe, the following effects can be obtained.

An auxiliary wire line is disposed at outer side of a main wire line, and after that, the main and auxiliary wire lines are bound with an outermost wire, so that a flexible wire having an eccentricity other than a circular cross section is formed. Accordingly, a centrifugal force is maximized at a high speed rotation, so that scale produced in a large-diameter pipe can be effectively removed. In addition, a scale removing ability can be greatly improved.

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

The invention claimed is:

1. A flexible wire for removing scales in pipe, comprising:

a main wire line which is formed by alternately winding a central wire line with clockwise and counterclockwise wires along a longitudinal direction of the central wire line;

an auxiliary wire line which is a single line having a diameter smaller than that of the main wire line and extends at one side of the main wire line in a longitudinal direction of the main wire line so that the flexible wire is formed to have a cross section having an eccentricity; and an outermost wire which winds the auxiliary wire line so as to bind the auxiliary wire line and the main wire line.

2. The flexible wire of claim 1, wherein the outermost wire is in direct contact with both the main wire line and the auxiliary wire line.

* * * * *